343-700 MS AU 256 EX
4/4/78 OR 4,083,046

United States Patent [19] [11] 4,083,046
Kaloi [45] Apr. 4, 1978

[54] ELECTRIC MONOMICROSTRIP DIPOLE ANTENNAS

[75] Inventor: Cyril M. Kaloi, Thousand Oaks, Calif.

[73] Assignee: The United States of America as represented by the Secretary of the Navy, Washington, D.C.

[21] Appl. No.: 740,694

[22] Filed: Nov. 10, 1976

[51] Int. Cl.[2] ..... H01Q 1/38
[52] U.S. Cl. ..... 343/700 MS; 343/829
[58] Field of Search ..... 343/700 MS, 829, 830, 343/846

[56] References Cited

U.S. PATENT DOCUMENTS 3,810,183 5/1974 Krutsinger et al. ..... 343/708

*Primary Examiner*—Eli Lieberman
*Attorney, Agent, or Firm*—Richard S. Sciascia; Joseph M. St.Amand

[57] ABSTRACT

The electric monomicrostrip dipole antenna is a family of new electric microstrip antennas. The electric monomicrostrip dipole antenna consists of a thin electrically conducting element formed on one side of a dielectric substrate; the ground plane being on the other side of the substrate. The length of the radiating element is equal to the length of the ground plane, and the width of the ground plane extending beyond each side of the element at the width of the element (e.g., approximately 1/8 wavelength) to provide an isotropic radiation pattern. The thickness of the substrate to a large extent determines the bandwidth of the antenna, and the length of the conducting element and ground plane determines the resonant frequency.

60 Claims, 43 Drawing Figures

RETURN LOSS VS FREQUENCY

XY PLANE PLOT
2116 MHz
E φ

XZ PLANE PLOT
2116 MHz
E θ

ELECTRIC MONOMICROSTRIP DIPOLE ANTENNAS

This invention is related to U.S. Pat. No. 3,947,850 issued Mar. 30, 1976 for NOTCH FED ELECTRIC MICROSTRIP DIPOLE ANTENNA; U.S. Pat. No. 3,978,488 issued Aug. 31, 1976 for OFFSET FED ELECTRIC MICROSTRIP DIPOLE ANTENNA; U.S. Pat. No. 3,972,049 issued July 27, 1976 for ASYMMETRICALLY FED ELECTRIC MICROSTRIP DIPOLE ANTENNA; U.S. Pat. No. 3,984,834 issued Oct. 5, 1976 for DIAGONALLY FED ELECTRIC MICROSTRIP DIPOLE ANTENNA; and, U.S. Pat. No. 3,972,050 issued July 27, 1976 for END FED ELECTRIC MICROSTRIP QUADRUPOLE ANTENNA, all by Cyril M. Kaloi and commonly assigned.

This invention is also related to copending U.S. Pat. Applications:

Ser. No. 740,696 for NOTCHED/DIAGONALLY FED ELECTRIC MICROSTRIP DIPOLE ANTENNA;

Ser. No. 740,690 for TWIN ELECTRIC MICROSTRIP DIPOLE ANTENNAS; and,

Ser. No. 740,692 for CIRCULARLY POLARIZED ELECTRIC MICROSTRIP ANTENNAS;

all filed together herewith on Nov. 10, 1976 by Cyril M. Kaloi, and commonly assigned.

The present invention is related to antennas and more particularly to microstrip type antennas, especially to microstrip antennas that can be excited to radiate about both sides of the antenna and provide near isotropic radiation.

SUMMARY OF THE INVENTION

The electric monomicrostrip dipole antenna is a family of new electric microstrip antennas. In this type antenna, the excited element radiates on both the element and ground plane sides of the antenna. The electric monomicrostrip dipole antenna consists of a thin electrically-conducting element formed on one side of a dielectric substrate. The ground plane is on the opposite side of the substrate and the length of the ground plane is equal to the length of the radiating element. The width of the ground plane must extend beyond the width of the sides of the element to provide an isotropic radiation pattern. This extension of the width of the ground plane should, for example, be at least about ⅛ wavelength. Various shapes such as rectangles, squares, circles, elipses, triangles, trapezoids; T, I and L-shapes, cut-outs, elements within elements, etc., may be used for the radiating elements. In some instances both the elements and microstrip transmission lines can be photoetched simultaneously on the substrate. The thickness of the substrate to a large extent determines the bandwidth of the antenna. The length of the conducting element and ground plane determines the resonant frequency. The electric monomicrostrip antennas are very useful in co-linear type arrays, such as stacked or stand-up antennas and can be used on buoys, towers, boats, aircraft, etc.

This family of electric microstrip antennas differ from earlier filed families of microstrip antennas, such as those aforementioned, in that a single excited element radiates on both the element side and ground plane side of the antenna. In previous microstrip antennas, the ground plane being substantially larger than the radiating element could not be excited at the same resonant frequency as the radiating element. In the case of the aforementioned copending Twin Electric Microstrip Antenna, duplicate elements are excited on opposite sides of the dielectric to provide radiation on both sides of the antenna. In the Twin Electric Microstrip Antenna, the radiation on one side is 180° out of phase with the radiation on the opposite side. In the monomicrostrip dipole antennas only one element is excited; however, since the ground plane length is the same as the element length, the fields generated by the element tend to spill over, along the length, to the ground plane side of the antenna such that there is radiation on both sides of the antenna assembly that is in phase.

Bandwidth of the electric monomicrostrip antennas disclosed herein is dependent upon the thickness of the substrate and width of the elements. Monomicrostrip antennas with widths as narrow as the thickness of the substrate have been constructed and operated with satisfactory results.

There are a number of different monomicrostrip antennas described herein each having different electrical characteristics and feed systems. These are:

Notched Fed Electric Monomicrostrip Dipole Antennas;

End Fed Electric Monomicrostrip Dipole Antennas;

Offset Fed Electric Monomicrostrip Dipole Antennas;

Asymmetrically Fed Electric Monomicrostrip Dipole Antennas;

Diagonally Fed Electric Monomicrostrip Dipole Antennas; and

Notched/Diagonally Fed Electric Monomicrostrip Dipole Antennas.

Other element shapes, such as circles, elipses, triangles, trapezoids, I, T and L-shapes, cut-outs, element within an element, etc., can be fed in various ways like the above listed antennas to provide a variety of electrical characteristics.

This antenna is perhaps one of the few antennas that approaches isotropic radiation. At the present, this is the only microstrip antenna that approaches true isotropic radiation. In the past, other techniques have been tried in attempts to approach near isotropic radiation, but have not attained the success of the present antenna to provide substantially isotropic radiation.

Another advantage of the electric monomicrostrip antennas over most other types of microstrip antennas is that the present antenna can be fed very easily with a coaxial-to-microstrip adapter from the ground plane side with twin microstrip transmission line or with a combination of twin microstrip and single microstrip transmission lines.

BRIEF DESCRIPTION OF THE DRAWINGS

FIGS. *1a, 1b, 1c, 1d, 1e* and *1f* show the coordinate system used for the: Notched Fed, End Fed, Offset Fed, Asymmetrically Fed, Diagonally Fed, and Notched/-Diagonally Fed Electric Monomicrostrip Antennas, respectively.

FIGS. *2a* and *2b* show the near field configuration for a typical monomicrostrip antenna, particularly for the notched fed, end fed and asymmetrically fed antennas, and to some extent for the offset fed antenna.

FIGS. *3a, 3b* and *3c* show a planar view of the element side, an edge view, and a planar view of the ground plane side, respectively, of a typical notch fed electric monomicrostrip antenna.

Figure 3A:
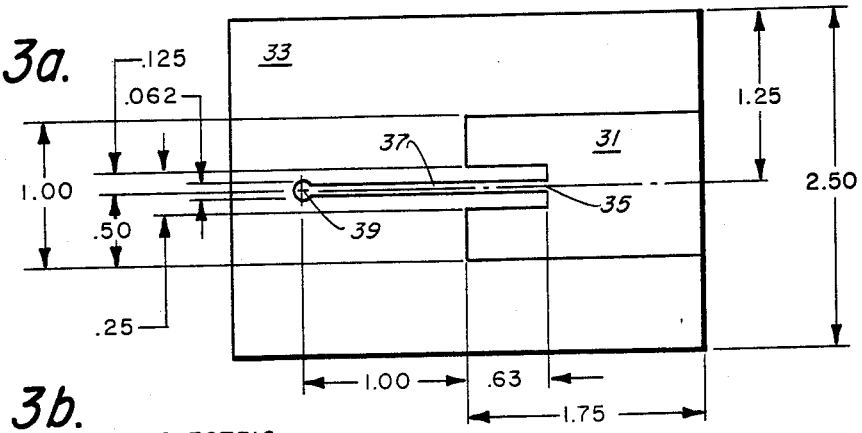
Figure 3B:
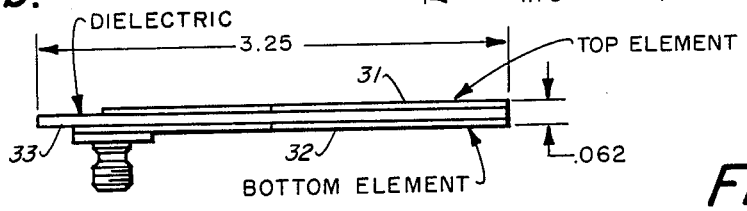
Figure 3C:
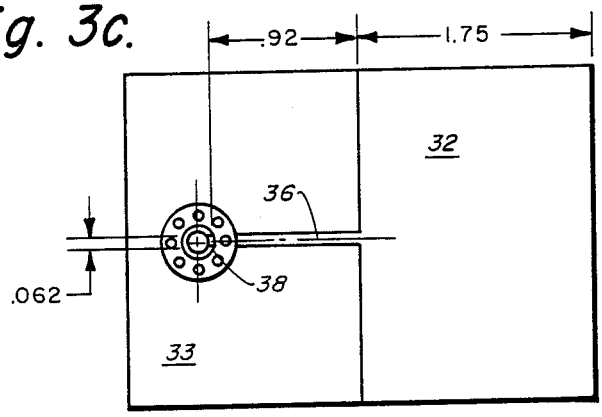
Figure 3D:
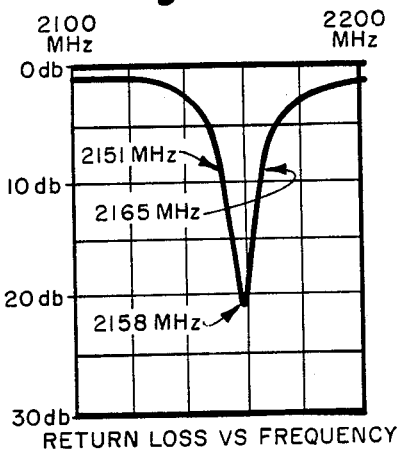

FIG. 3*d* is a plot showing the return loss versus frequency for the notch fed electric monomicrostrip antenna shown in FIGS. 3*a*, 3*b* and 3*c*.

Figure 3E:
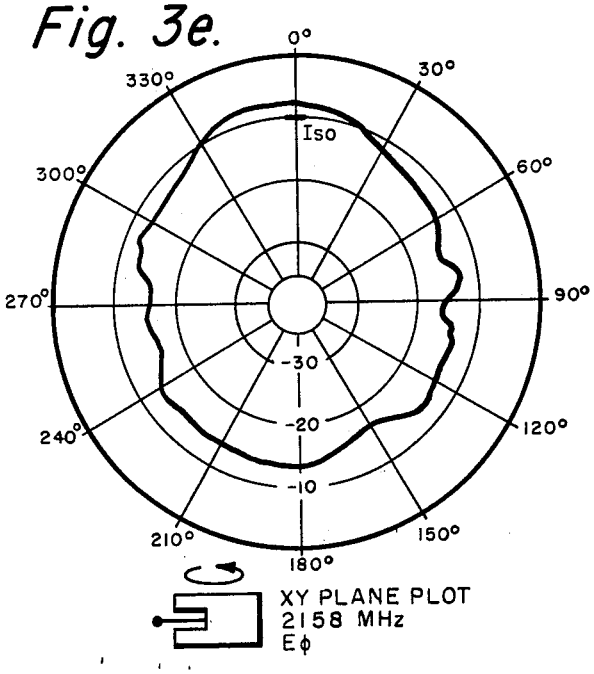
Figure 3F:
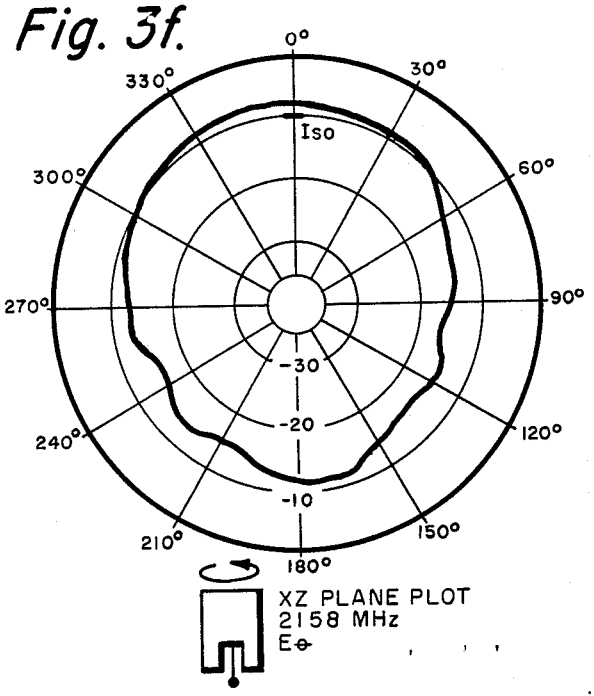

FIGS. 3*e* and 3*f* show antenna radiation patterns for the XY plane and XZ plane, respectively, for a typical notch fed electric monomicrostrip antenna having the dimensions given in FIGS. 3*a*, 3*b* and 3*c*.

Figure 4A:
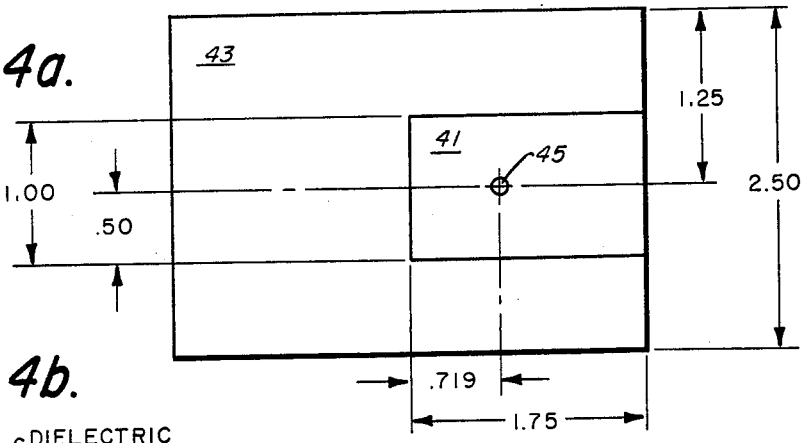
Figure 4B:
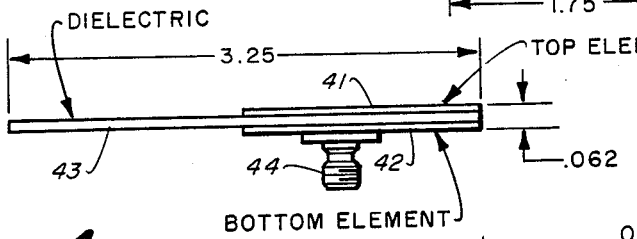
Figure 4C:
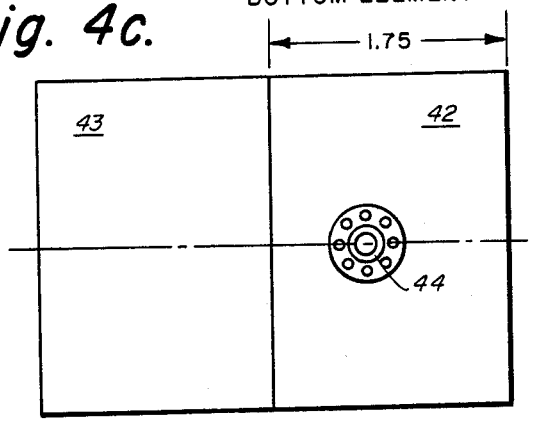

FIGS. 4*a*, 4*b* and 4*c* show a planar view of the element side, an edge view, and a planar view of the ground plane side, respectively, of a typical asymmetrically fed electric monomicrostrip antenna.

Figure 4D:
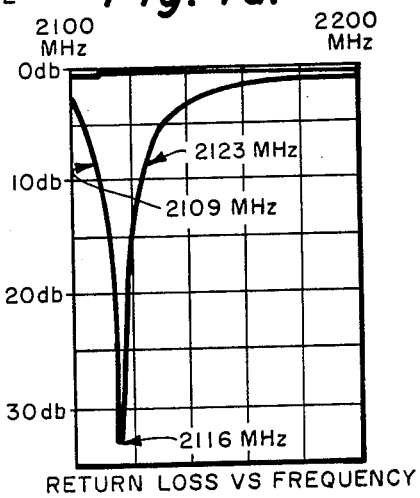

FIG. 4*d* is a plot showing the return loss versus frequency for the asymmetrically fed electric monomicrostrip antenna shown in FIGS. 4*a*, 4*b* and 4*c*.

Figure 4E:
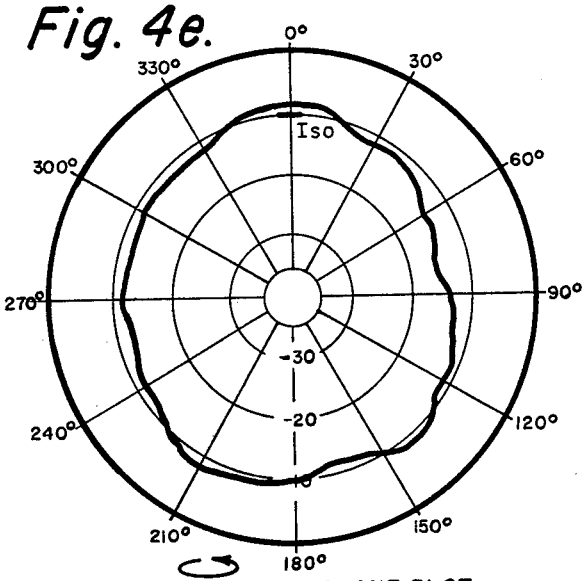
Figure 4F:
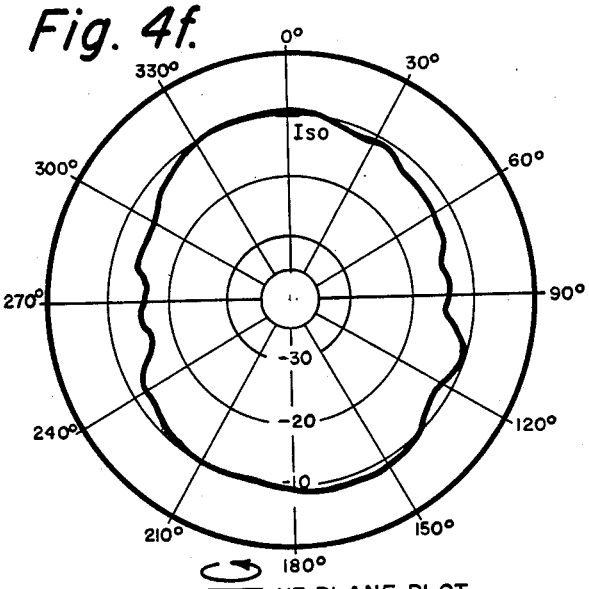

FIGS. 4*e* and 4*f* show antenna radiation patterns for the XY plane and XZ plane, respectively, for a typical asymmetrically fed electric monomicrostrip antenna having the dimensions given in FIGS. 4*a*, 4*b* and 4*c*.

Figure 5A:
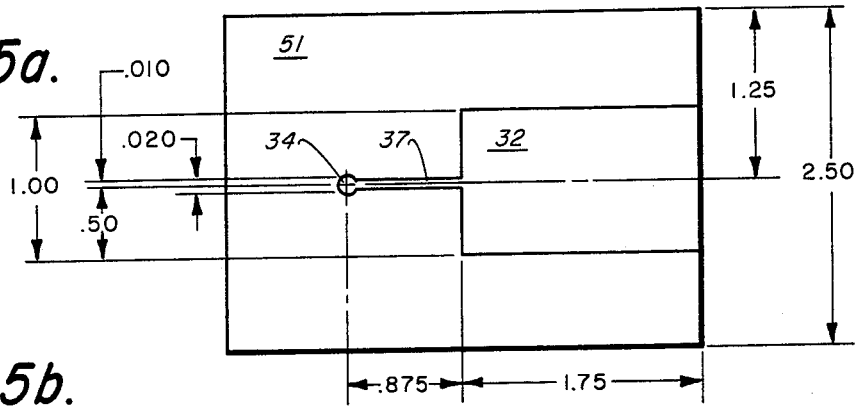
Figure 5B:
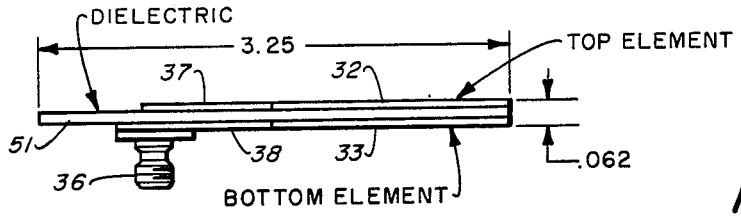
Figure 5C:
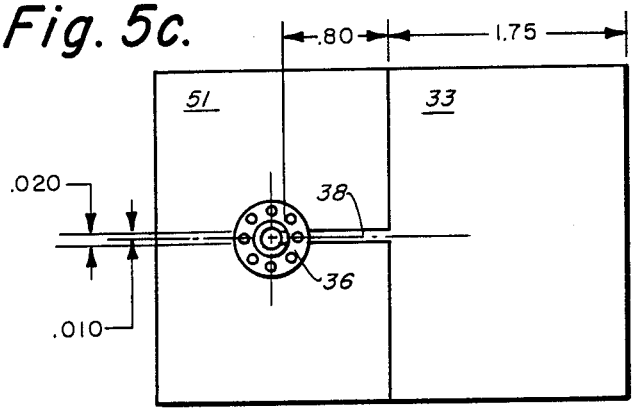

FIGS. 5*a*, 5*b* and 5*c* show a planar view of the element side, an edge view, and a planar view of the ground plane side, respectively, of a typical end fed electric monomicrostrip antenna.

Figure 5D:
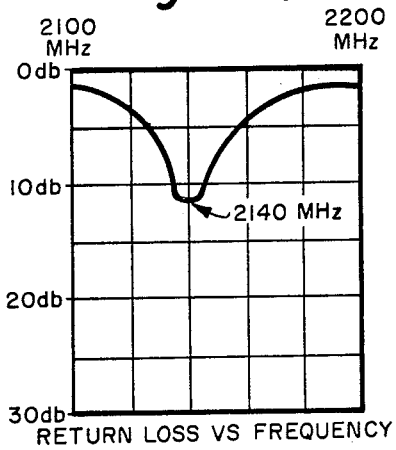

FIG. 5*d* is a plot showing the return loss versus frequency for the end fed electric monomicrostrip antenna shown in FIGS. 5*a*, 5*b* and 5*c*.

Figure 5E:
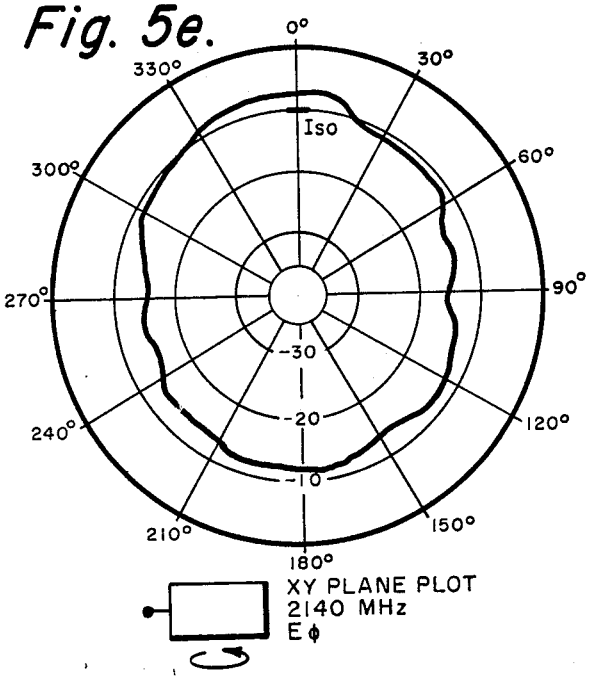
Figure 5F:
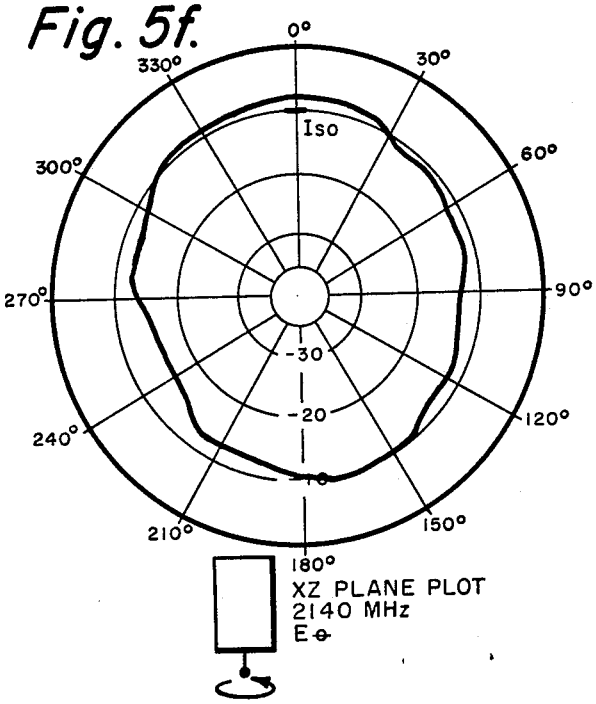

FIGS. 5*e* and 5*f* show antenna radiation patterns for the XY plane and XZ plane, respectively, for a typical end fed electric monomicrostrip antenna having the dimensions given in FIGS. 5*a*, 5*b* and 5*c*.

Figure 6A:
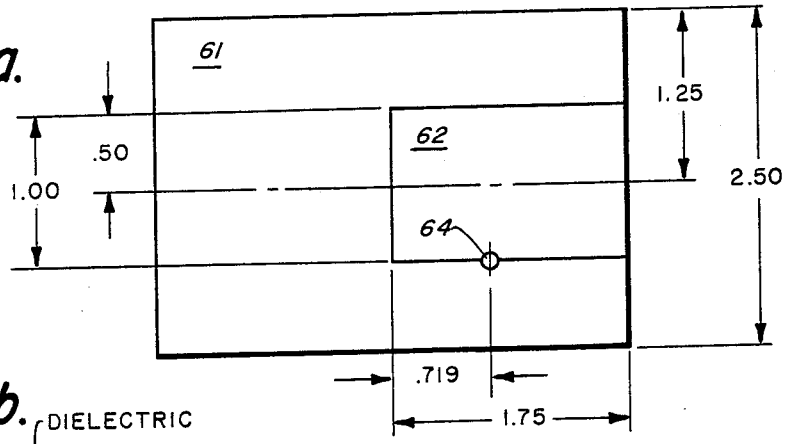
Figure 6B:
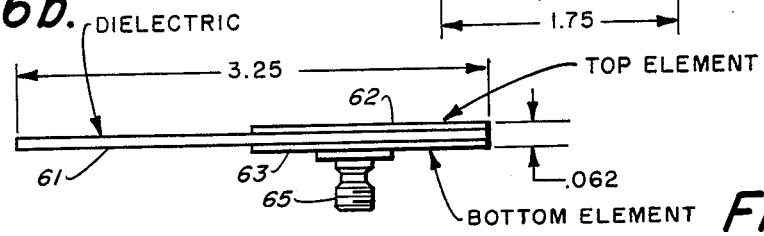
Figure 6C:
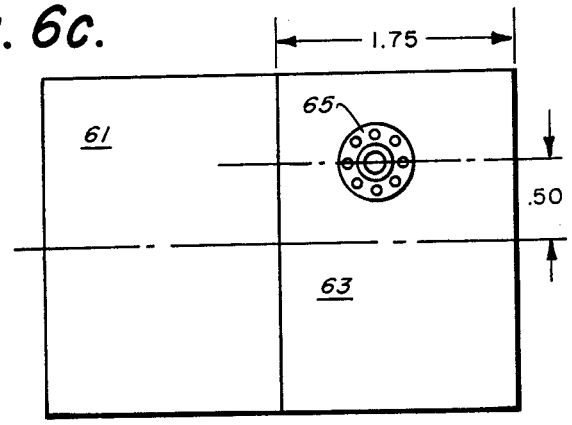

FIGS. 6*a*, 6*b*, and 6*c* show a planar view of the element side, an edge view, and a planar view of the ground plane side, respectively, of a typical offset fed electric monomicrostrip antenna.

Figure 6D:
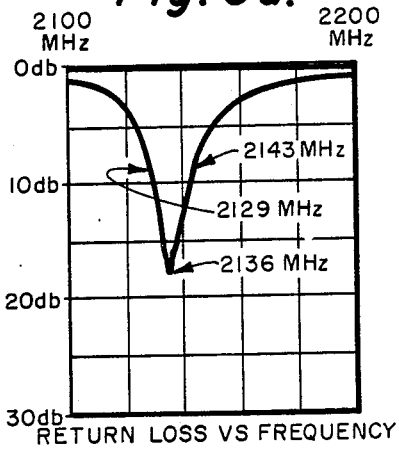

FIG. 6*d* is a plot showing the return loss versus frequency for the offset fed monomicrostrip antenna shown in FIGS. 6*a*, 6*b*, and 6*c*.

Figure 6E:
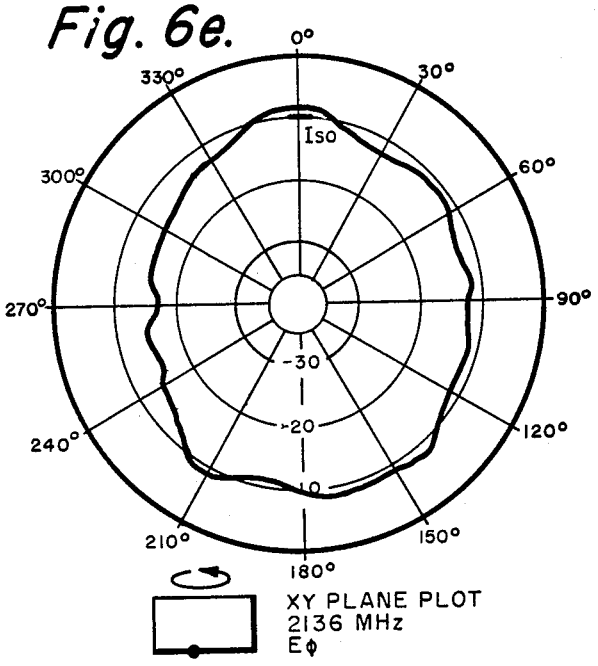
Figure 6F:
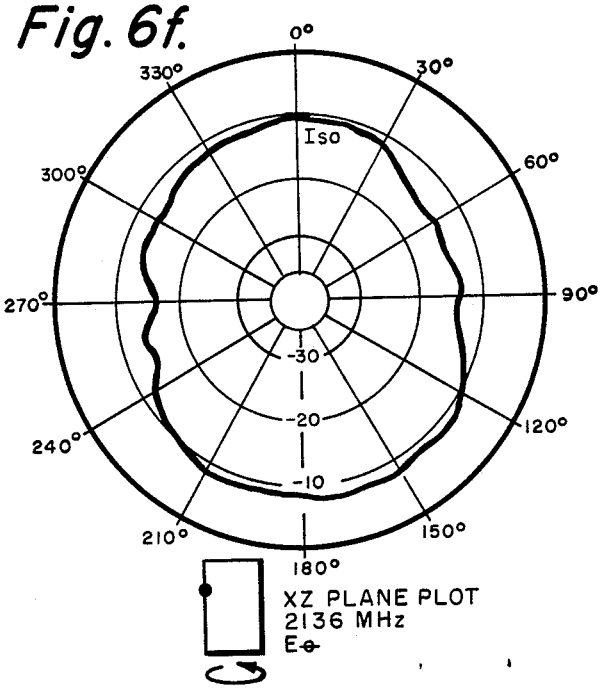

FIG. 6*e* and 6*f* show antenna radiation patterns for the XY plane and XZ plane, respectively, for the typical offset fed electric monomicrostrip antenna having the dimensions given in FIGS. 6*a*, 6*b* and 6*c*.

Figure 7A:
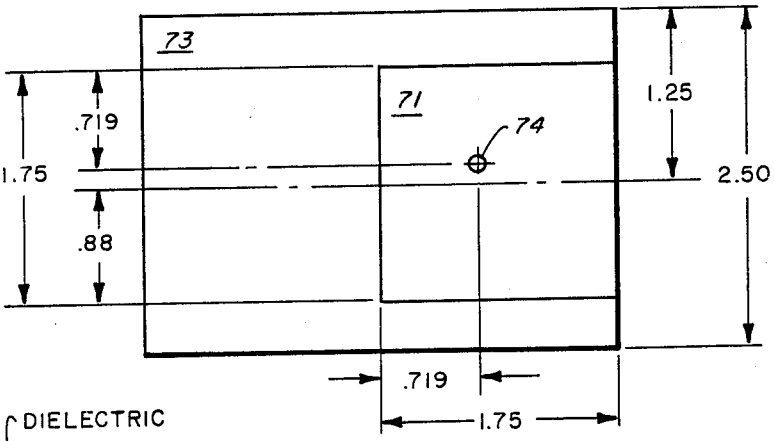
Figure 7B:
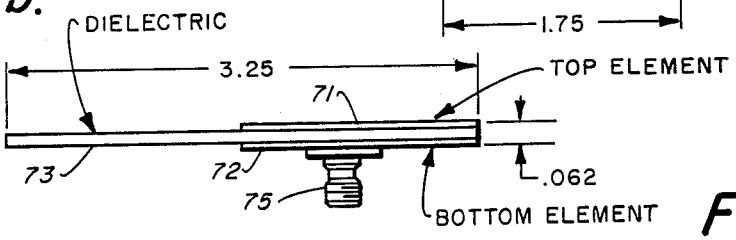
Figure 7C:
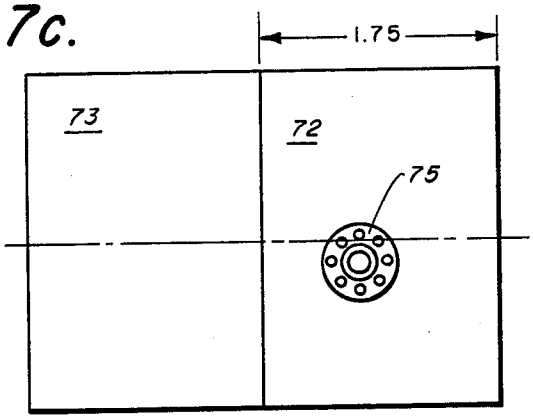

FIGS. 7*a*, 7*b* and 7*c* show a planar view of the element side, an edge view, and a planar view of the ground plane side, respectively, of a typical diagonally fed electric monomicrostrip antenna.

Figure 7D:
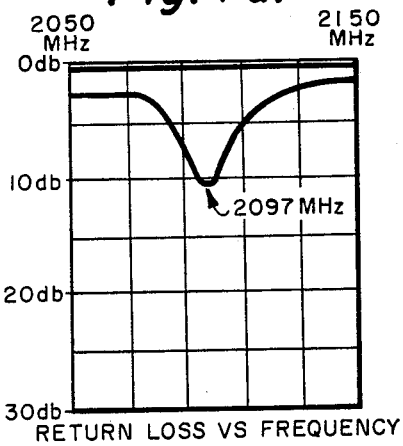

FIG. 7*d* is a plot showing the return loss versus frequency for the diagonally fed monomicrostrip antenna shown in FIGS. 7*a*, 7*b*, and 7*c*.

Figure 7E:
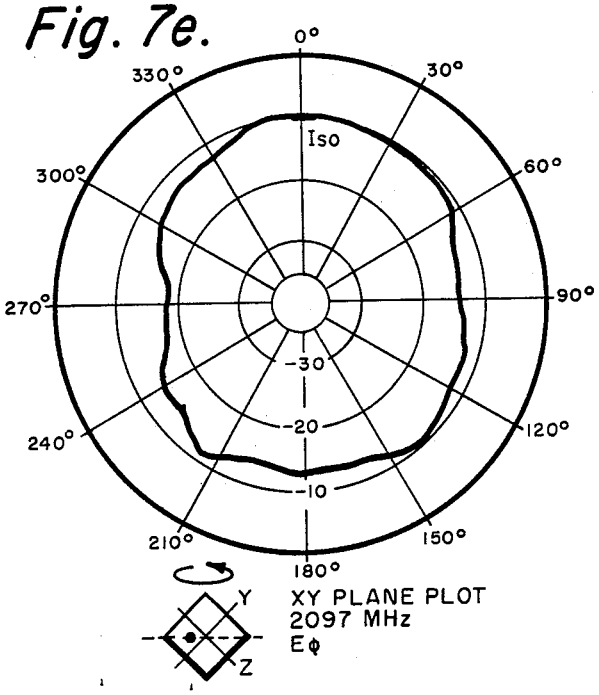
Figure 7F:
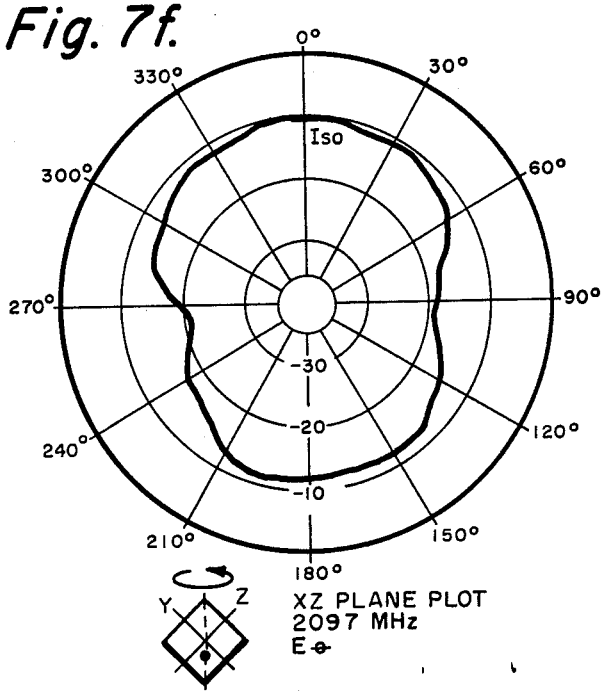

FIGS. 7*e* and 7*f* show antenna radiation patterns for the XY plane and XZ plane, respectively, for the typical diagonally fed electric monomicrostrip antenna having the dimensions given in FIGS. 7*a*, 7*b*, and 7*c*.

Figure 8A:
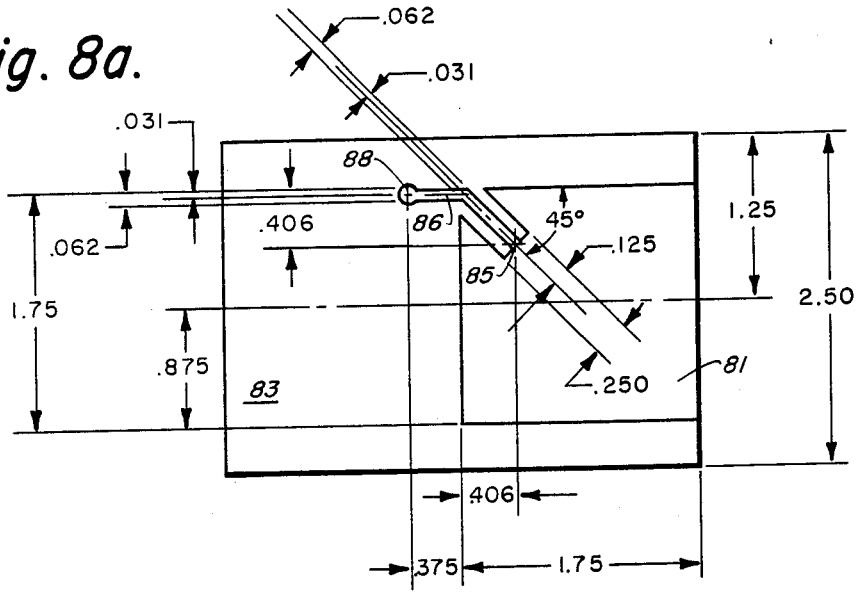
Figure 8B:
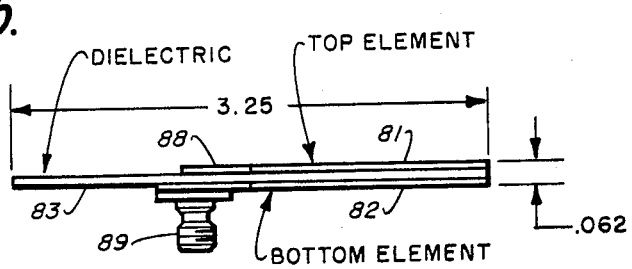
Figure 8C:
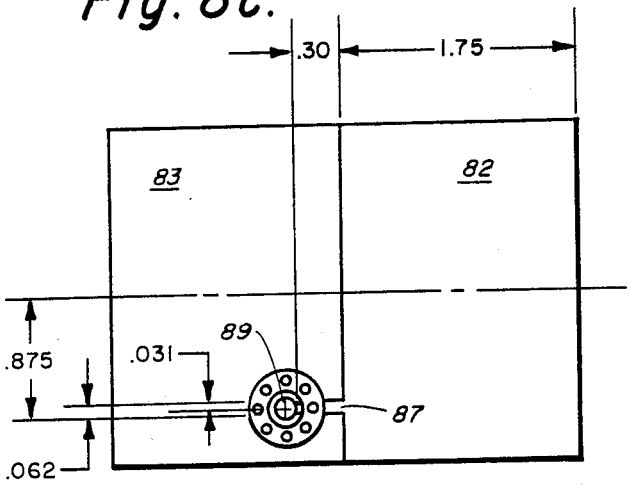

FIGS. 8*a*, 8*b* and 8*c* show a planar view of the element side, an edge view, and a planar view of the ground plane side, respectively, of a typical notched/-diagonally fed electric monomicrostrip antenna.

Figure 8D:
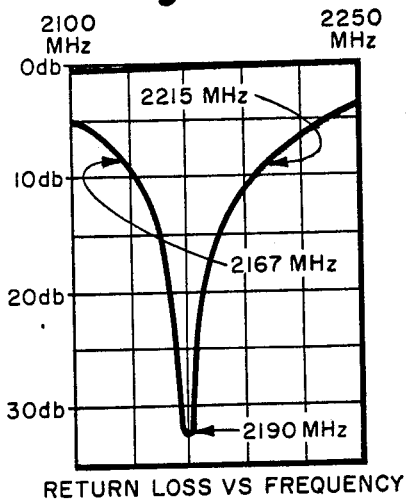

FIG. 8*d* is a plot showing the return loss versus frequency for the notched/diagonally fed monomicrostrip antenna shown in FIGS. 8*a*, 8*b* and 8*c*.

Figure 9:
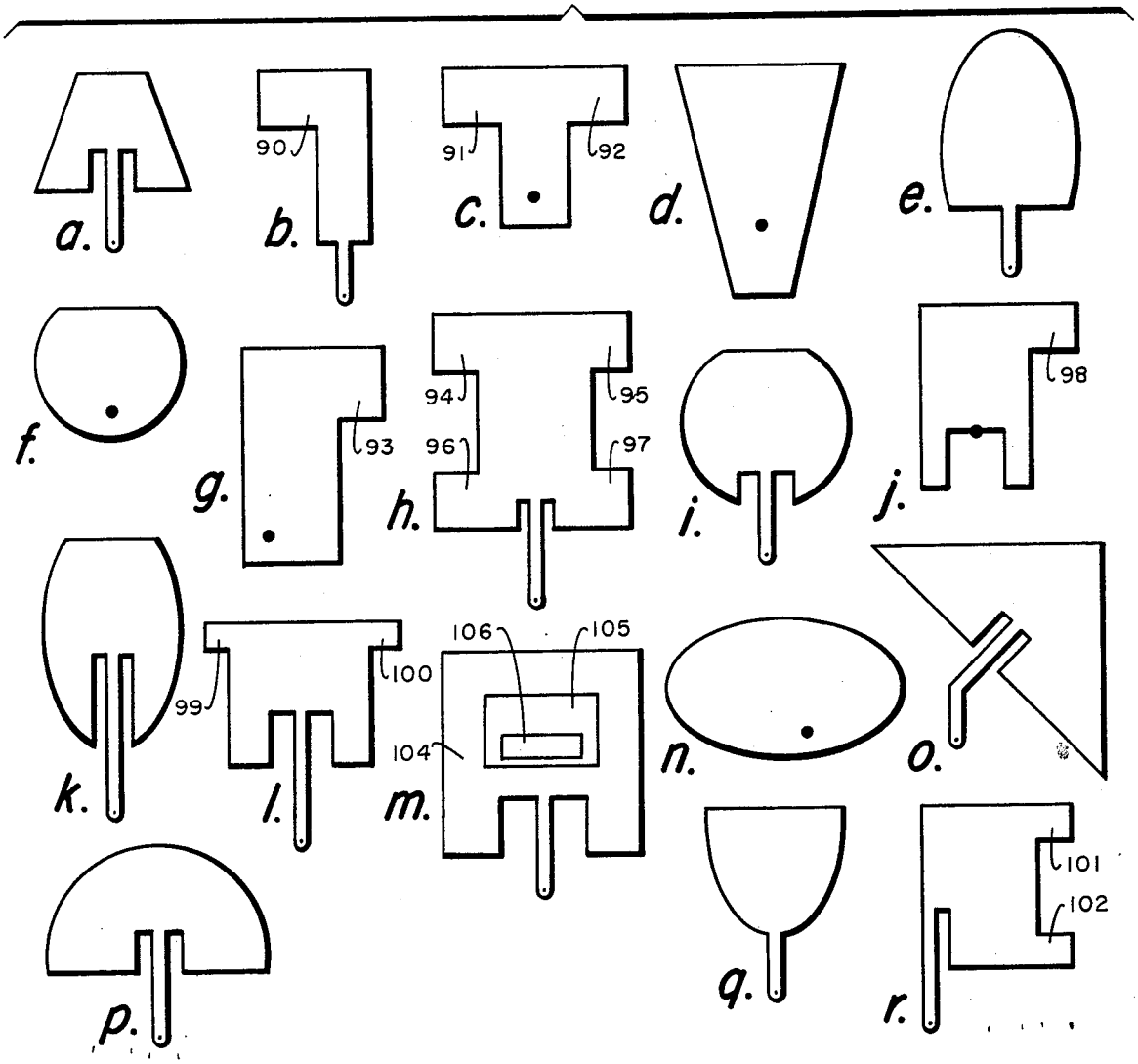

FIGS. 9*a* through 9*r* show a variety of shapes for electric monomicrostrip antenna radiating elements using various feed systems.

DESCRIPTION AND OPERATION

The coordinate system used for various types of the electric monomicrostrip antenna family and the alignment of the antenna element within this coordinate system are shown in FIGS. 1*a*, 1*b*, 1*c*, 1*d*, 1*e*, and 1*f*. The above coordinate systems are in accordance with IRIG (Inter Range Instrumentation Group) standards and alignment of the antenna elements were made to coincide with the actual antenna patterns that will be shown later. In the case of the electric monomicrostrip antenna, the A dimension is the length of the antenna element and the length of the ground plane. The B dimension is the width of the antenna element, and the H dimension is the dielectric substrate thickness. The BG dimension is the width of the ground plane and should be wider than the element, and must extend some on each side of the element, to obtain an isotropic radiation pattern. Approximately $\frac{1}{8}$ wavelength extension of the ground plane on each side in the width dimension operates satisfactorily. The BG dimension can be greater than the recommended approximately $\frac{1}{8}$ wavelength on each side, if desired, and the ground plane can extend on one side more than the other in the width dimension. The total BG dimension thus should exceed the B dimension by at least approximately $\frac{1}{4}$ wavelength.

In the monomicrostrip dipole antennas, only one element is excited. Since the ground plane length is the same as the length of the radiating element, the fields generated by the element tend to spill over to the ground plane side of the antenna such that there is radiation on both sides of the antenna, without the ground plane being excited. The result is near isotropic radiation with only one element excited.

Figure 1A:
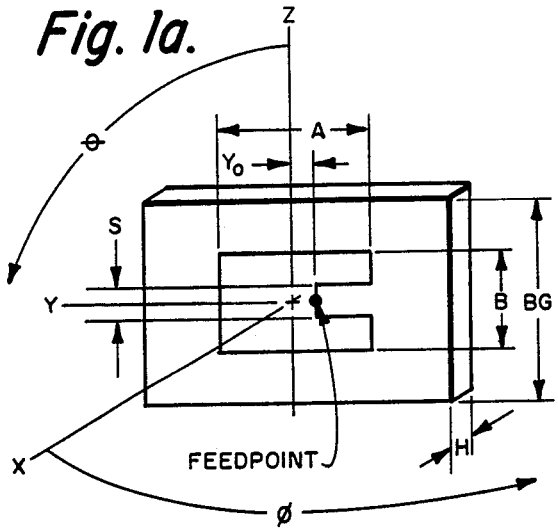
Figure 1B:
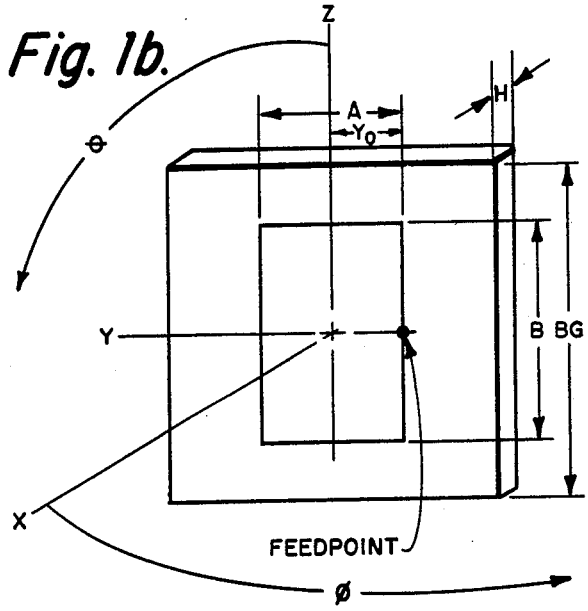
Figure 1C:
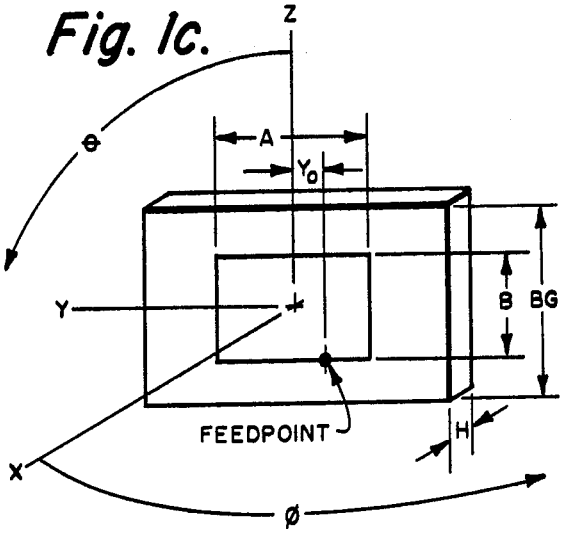
Figure 1D:
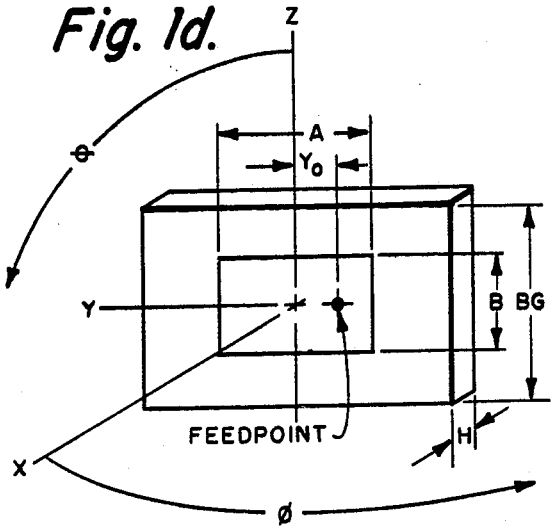
Figure 1E:
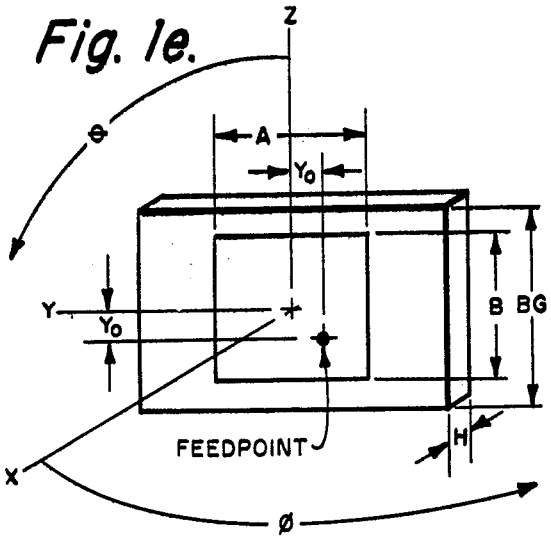
Figure 1F:
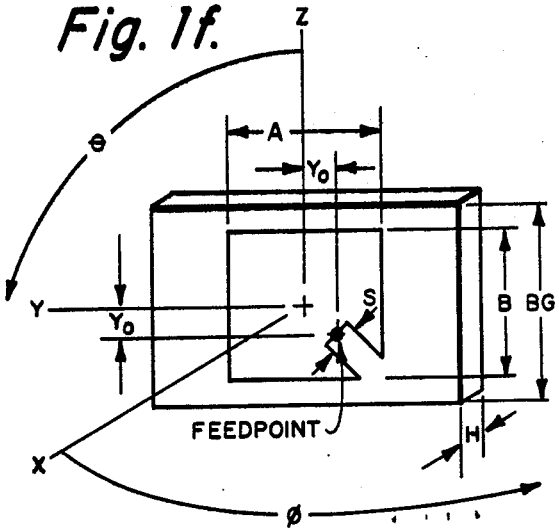

Making the ground plane wider than the radiating element on each side thereof loads or de-tunes the ground plane (i.e., causes a mismatch) such that the ground plane is not excited. Other forms of loading or de-tuning the ground plane can be used provided, however, that the means used to cause a mismatch does not interfere with or disturb the fields. The element length A of the electric monomicrostrip antennas is approximately $\frac{1}{2}$ wavelength. The radiating element and ground plane are aligned lengthwise directly opposite each other. $Y_o$ is the distance the feed point is located from the element centerpoint on the centerline along the element length in FIGS. 1*a*, 1*b* and 1*d*. In FIG. 1*c*, $Y_o$ is the dimension that the feed point is located along the element edge from the centerline across the width of the element. In FIGS. 1*e* and 1*f*, the dimension $Y_o$ is the distance the feed point is located from the centerlines of both the width and the length of the element; the resultant of the two $Y_o$ vectors is the distance from the centerpoint along the diagonal of the element. In FIGS. 1*a* and 1*f*, the dimension S is the width of the notch and is determined much by the width of the microstrip transmission lines. The thickness of the dielectric substrate, dimension H, in the electric monomicrostrip antennas should be much less than $\frac{1}{4}$ the wavelength. For thicknesses approaching $\frac{1}{4}$ wavelength, an antenna will radiate in a hybrid mode in addition to radiating in a microstrip mode. The extension of the dielectric substrate beyond the length of the element in either direction is not required for proper operation of the antenna. However, for practical purposes, such an extension can be used for mounting purposes and/or etching transmission lines. In addition, the electric monomicrostrip antennas can be designed for any desired frequency within a limited bandwidth, preferably below 25 GHz. The antenna will tend to operate in a hybrid mode (e.g., a microstrip/monopole mode) above 25 GHz for most commonly used stripline materials. However, for clad materials thinner than 0.031 inch, higher frequencies can be used. The design technique used for these antennas provides antennas with ruggedness, simplicity and low cost. The thickness of the present antennas can be held to an extreme minimum depending upon the bandwidth requirements; antennas as thin as 0.005 inch for frequencies above 1,000 MHz have been successfully produced. In most instances, the antenna is easily matched to most practical impedances by varying the location of the feed point along the element.

Figure 2A:
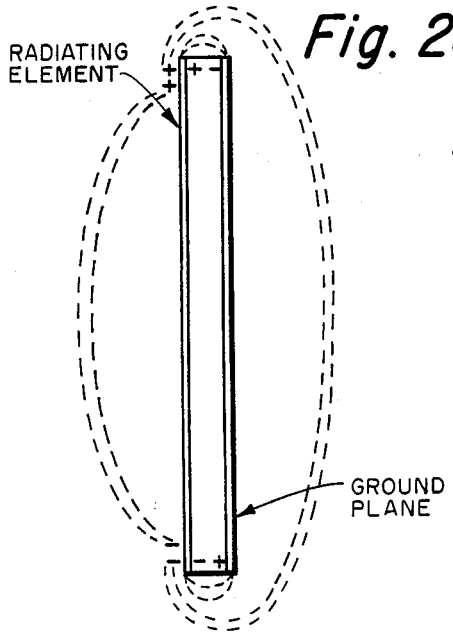
Figure 2B:
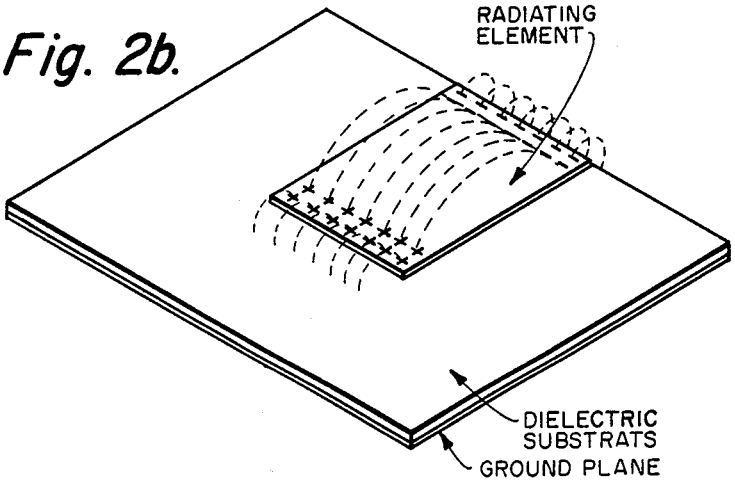

FIGS. 2*a* and 2*b* show the near field configuration for a typical electric monomicrostrip antenna. This configuration applies primarily to the notch fed, end fed, asymmetrically fed, and to some extent to the offset fed isotropic microstrip antenna, depending on the element width. FIG. 2*a* is an edge view, showing the ground plane and the element as being the same length. Both FIGS. 2*a* and 2*b* show how the fields extend completely around the antenna and ground plane along the length of the antenna. As to the offset fed monomicrostrip antenna, for widths approaching ½ wavelength cross-polarization components will occur, but for widths approaching ¼ wavelength or less, for example, the cross-polarization fields are very minimal. Usually the above antennas are rectangular with the element A dimension being greater than the B dimension. However, other shapes can be used as was previously indicated. As can be seen in FIGS. 2*a* and 2*b*, there are fields on each of the broad faces of the electric monomicrostrip antenna assembly that are in phase with each other. The resultant far field gives an omnidirectional radiation pattern around the width in the XZ plane. There are also fields on the edges along the end sides, element B dimension, of the antenna, as shown. These fields along the end edges of the antenna are similar to waveguide radiation type fields. The results of the above near fields give an omnidirectional far field pattern in the XY plane around the length of the antenna, as will be shown. The resultant omnidirectional patterns in the XY and XZ planes are an indication that the overall radiation of each of the monomicrostrip antennas is isotropic. The near field configuration also indicates that the polarization is linear along the length of the antenna.

The elements of the electric monomicrostrip dipole antennas can be arrayed with interconnecting twin and/or single microstrip transmission lines, and in most instances these microstrip transmission lines can be simultaneously etched along with the elements on the substrate. A coaxial-to-microstrip adapter can be used for feeding the monomicrostrip antenna elements. The adapter is mounted and electrically connected to the ground plane on one side of the antenna with the center pin of the adapter extending through the substrate and electrically connected to the radiating element on the opposite side of the substrate. In some instances, the coaxial-to-microstrip adapter is connected to the connection ends of etched twin microstrip transmission line as can be seen in the drawings.

FIGS. 3*a*, 3*b* and 3*c* show a typical notch fed electric monomicrostrip antenna. The notched element 31 is spaced from ground plane 32 by dielectric substrate 33. An advantage of the monomicrostrip notch fed antenna is that it is possible to notch to the feed point 35 for optimum match of input impedance. The antenna can be fed from the ground side with a coaxial-to-microstrip adapter at the feed point. However, an added advantage is that the electric notch fed monomicrostrip antenna can be fed with a combination of twin and single etched microstrip transmission lines 36 and 37 at the optimum match location, as shown in FIGS. 3*a*, 3*b* and 3*c*. A coaxial-to-microstrip adapter 38 is connected to the connector end 39 of the twin microstrip transmission lines. This is a more desirable method of feed especially when arraying several elements. As shown in the drawings for each of the monomicrostrip antennas, the ground plane is wider than the element width by about ⅛ wavelength on each side. The element and ground plane lengths are equal. A variance of the notch fed monomicrostrip antenna is to notch the ground plane in addition to the element and feed both the element and ground plane with a twin microstrip transmission line. When using twin microstrip transmission lines, the type feed used is optional.

FIG. 3*d* shows the return loss versus frequency for a typical notched fed electric monomicrostrip dipole antenna having dimensions as given in FIGS. 3*a*, 3*b* and 3*c*. Radiation patterns for the XY and XZ planes are shown in FIGS. 3*e* and 3*f*, respectively, for this antenna indicating the isotropic characteristics thereof.

FIGS. 4*a*, 4*b* and 4*c* show a typical asymmetrically fed electric monomicrostrip antenna. Element 41 is separated from ground plane 42 by dielectric substrate 43. This antenna is fed by means of a coaxial-to-microstrip adapter 44. The feed point 45 is located along the centerline of the antenna length and the input impedance can be varied by moving the feed point along the centerline from the center point to the end of the antenna without affecting the radiation pattern. As can be seen, the ground plane length is the same dimension as the element length. The ground plane is wider than the element by at least ⅛ wavelength on each side of the element, as shown. The antenna bandwidth increases with the width of the element and dielectric thickness between the element and ground plane with the spacing between the element and ground plane having the most effect. FIG. 4*d* shows the return loss versus frequency for a typical asymmetrically fed electric monomicrostrip dipole antenna having dimensions as given in FIGS. 4*a*, 4*b* and 4*c*. Radiation patterns for the XY and XZ planes are shown in FIGS. 4*e* and 4*f*, respectively, for this antenna indicating the isotropic characteristics thereof. Arraying is usually done with external coaxial feed lines. This antenna element can be made as narrow as the substrate thickness, for example, 0.093 inch.

FIGS. 5*a*, 5*b* and 5*c* show a typical end fed electric monomicrostrip antenna. Dielectric substrate 51 separates element 32 from ground plane 33. Because of the very high impedance at the end of the antenna element, a matching network must be used between the connecting point 34 and the actual feed point 35. The antenna is excited from a coaxial-to-microstrip adapter 36 at point 34. Matching network 37 and 38 can be etched along with the elements as shown in the drawing. FIG. 5*d* shows the return loss versus frequency for a typical end fed electric monomicrostrip dipole antenna having dimensions as given in FIGS. 5*a*, 5*b* and 5*c*. Radiation patterns for the XY and XZ planes are shown in FIGS. 5*e* and 5*f*, respectively, for this antenna indicating the isotropic characteristics thereof. The electric end fed and notch fed monomicrostrip antenna elements can be arrayed using microstrip interconnecting transmission lines etched along with the elements.

FIGS. 6*a*, 6*b* and 6*c* show a typical electric offset fed monomicrostrip antenna. As in the other antennas, a dielectric substrate 61 separates element 62 from ground plane 63. An advantage of the twin offset fed antenna is that it can be fed at the optimum feed point 64 with etched twin microstrip lines, or directly at the feed point with a coaxial-to-microstrip adapter 65, as shown in the drawings. This antenna element can also be made as narrow as the substrate thickness, for example, 0.093 inch. FIG. *6d* shows a plot of the return loss versus frequency for a typical offset fed electric monomicrostrip antenna having dimensions as given in FIGS. *6a, 6b* and *6c*. Radiation patterns for the XY and XZ planes are shown in FIGS. *6e* and *6f*, respectively, for this antenna and indicate the isotropic characteristics thereof.

FIGS. *7a, 7b* and *7c* show a typical diagonally fed electric monomicrostrip antenna. Radiating element 71 is separated from the ground plane 72 by dielectric substrate 73. The feed point 74 is located along the diagonal and the input impedance can be varied to match any source impedance by moving the feed point along the diagonal line of the antenna element without affecting the radiation pattern. A coaxial-to-microstrip adapter 75 is used to feed the antenna. The element should be square for linear polarization and for circular polarization the element B dimension (i.e., width) should be slightly shorter than the element A dimension (i.e., length), or vice versa, depending on whether right hand or left hand circular polarization is desired. Only one feed point is required to obtain circular polarization. This antenna can only be arrayed with coaxial-to-microstrip adapters and external coaxial cables. In the case of an exact square element, the polarization is linear along the diagonal feed line on both sides of the antenna, in a manner similar to that shown in FIG. *2a*, with the fields in phase on both sides of the antenna. FIG. *7d* shows a plot of the return loss versus frequency for a typical diagonally fed electric monomicrostrip dipole antenna having dimensions as given in FIGS. *7a, 7b* and *7c*. FIGS. *7e* and *7f* show typical radiation patterns taken in the diagonal planes between the XY and XZ planes, respectively, as shown. Cross-polarization components are minimal for the square element shown and therefore are not shown. The radiation patterns of FIGS. *7e* and *7f* indicate linear polarization for the antenna dimensions given. The width of the notch, dimension S, is determined much by the width of the microstrip feed line 86. What is considered cross-polarization in a linear polarized antenna would be normal polarization for an elliptical or circularly polarized antennas, as is indicated by the patterns in FIGS. *7e, 7f*, and *7g*. Circular polarization of this antenna is substantially the same as that discussed in aforementioned U.S. Pat. No. 3,984,834.

FIGS. *8a, 8b* and *8c* show a notched/diagonally fed electric monomicrostrip antenna. This antenna has an element 81, separated from the ground plane 82 by dielectric substrate 83. The dimension features of the diagonally fed antenna of FIGS. 7, described above, are also applicable here.

FIG. *8d* shows the return loss versus frequency plot for a typical notched/diagonally fed electric monomicrostrip antenna having the dimensions as given in FIGS. *8a, 8b* and *8c*.

The radiation patterns in the notched/diagonally fed electric monomicrostrip antenna are very similar to those shown for the diagonally fed antenna described above and therefore are not shown here.

In this antenna, the element 81 is notched along a diagonal from a corner to the desired feed point 85 and can be fed and arrayed with either type transmission line, and also with both the element 81 and ground plane 82 notched, if desired, as discussed for the notch fed monomicrostrip antenna of FIGS. 3. The drawings show etched microstrip transmission lines 86 and 87. Line 86 is used between connecting point 88 and the actual feed point 85. Line 87 connects the flange of coaxial-to-microstrip adapter 89 to ground plane 82. Linear or circular polarization are also possible with this type antenna as with the diagonally fed electric monomicrostrip antenna. The dimensional and single feed point requirements for circular polarization with this notched/diagonally fed antenna are substantially the same as described for the diagonally fed antenna above.

As was mentioned earlier, a variety of radiator shapes can be used for the monomicrostrip antenna elements for different purposes and under a variety of circumstances. FIGS. *9a* through *9r* show a variety of element shapes using various feed systems, by way of example.

In the L, I and T-shaped elements shown in FIGS. *9b, 9c, 9g, 9h, 9j, 9l*, as well as FIG. *9r*, the side or wing extensions 90, 91, 92, 93, 94, 95, 96, 97, 98, 99, 100, 101 and 102 on the elements act as reactive loads for each antenna. The effect of the loads is to obtain a lower frequency and yet not extend beyond the desired length of the antenna element but merely extend a portion of the element width. This type loading in the width provides a much more reactive load and reduces the center frequency of the antenna more than can be attained by increasing the width of the antenna radiating element the same amount along the entire length thereof. The T-shaped elements, such as in FIGS. *9c* and *9l*, can be used to double the reactive loading and the loads of the I-shaped element, such as in FIG. *9h*, will approximately quadruple the reactive loading for that element.

In the I-shaped elements, such as in FIG. *9h*, or in the element of FIG. *9r*, the loads along the length should not approach each other too closely since the reactive effect can be lost and the load portion become a part of the radiating element. In other words, load 94 should not be too close to load 96, 95 should not be close to 97, and 101 should not be close to 102. Various other configurations, as shown in FIGS. *9a* through *9r*, can be used to fit areas that require special space-saving techniques, etc., and can be fed with a variety of feed systems, as shown and previously described.

In the element 104 shown in FIG. *9m*, a center portion 105 can be cut out (i.e., removed) and this antenna can be notch fed, as shown, or fed by a variety of feed systems as discussed. If desired, a second and smaller antenna element 106 can be formed within the cut out area 105 and couple fed from the larger element 104. Each of the elements can be fed with separate feed lines, if desired. However, the smaller element 106 can be secondarily fed from the larger element 104, if desired, with a small transmission line from the larger element to the smaller element. A further means for feeding elements 104 and 106 would be to provide a microstrip T-feed line within space 105 between the two elements and feed both the larger and smaller elements from a common connection to a coaxial-to-microstrip adapter.

FIG. *9r* shows a loaded offset/notched microstrip antenna element. This is an example of how various feed systems and factors can be combined to meet special or complex physical constraints or electrical requirements in microstrip antenna design.

The various electric monomicrostrip antennas disclosed herein differ from one another both physically and in their electrical characteristics. The offset fed antennas can be connected directly to whatever input impedance match feed point is desired on the antenna by using twin microstrip transmission lines. In addition, the offset element can be made as narrow as the losses (i.e., copper and dielectric losses) allow (this is not true for the notch fed antenna, however). The asymmetrically fed antennas can be fed from one side and the element made as narrow as the losses permit. The notch fed antennas can be fed at the optimum feed point, but cannot be made as narrow as some of the other antennas due to the width of the notch. The polarization linearity of the notch fed, end fed and asymmetrically fed antennas are much purer than the offset fed antennas due to excitation of cross-feed components by virtue of the offset antennas being fed on the edges of the elements. Each of the various antenna types has a distinct advantage over the others, depending upon the location where used, type of feed, radiation patterns, etc.

In the diagonally fed and notched/diagonally fed electric monomicrostrip antennas, circular polarization occurs on the element side of the antenna only; polarization on the ground plane side is primarily lengthwise to the antenna. There are two modes of current oscillation. The fields that spill over to the ground plane side of the antenna are due to the dipole moments caused by current oscillations along the length of the antenna. When circular polarization is provided, the magnitude of the current oscillation along the width of the antennas is somewhat less than that along the length. In other words, since some of the energy along the length is spilled over to the ground plane side for radiation on the ground plane side, the energy needed along the length must be greater than that needed along the width by the amount of energy required to cause the spillover to the ground plane side, and this provides for circular polarization.

Obviously many modifications and variations of the present invention are possible in light of the above teachings. It is therefore to be understood that within the scope of the appended claims the invention may be practiced otherwise than as specifically described.

What is claimed is:

1. A notched fed electric monomicrostrip dipole antenna structure comprising:

a. a dielectric substrate;

b. a thin rectangular radiating element disposed on one side of said dielectric substrate;

c. a thin non-radiating ground plane conductor disposed on the other side of said dielectric substrate directly opposite to said radiating element;

d. said ground plane being identical in length to the length of said radiating element; said ground plane and said radiating element being aligned lengthwise;

e. said ground plane extending in width on each side beyond the width of said radiating element to cause a mismatch such that the ground plane will not be excited;

f. said radiating element operable to be excited to radiate about both the element and the ground plane side of the antenna in a near isotropic manner; the fields on both sides of the antenna being in phase;

g. the length of said radiating element determining the resonant frequency of the antenna;

h. said radiating element having a feed point located along the centerline of the length thereof;

i. said radiating element having a notch extending into the element along the centerline of the length from one end thereof to said feed point;

j. the antenna input impedance being variable to match most practical impedances as said feed point is moved along the element centerline without affecting the radiation pattern;

k. the antenna bandwidth being variable with the width of said radiating element and the spacing between the radiating element and said ground plane, the width of said notch being a factor as to the effective width of said radiating element, said spacing between the radiating element and the ground plane having somewhat greater effect on the bandwidth than the width of said radiating element.

2. An antenna as in claim 1 wherein said monomicrostrip antenna is fed from a coaxial-to-microstrip adapter from the ground plane side of the antenna with the center pin of the adapter extending through the ground plane and the dielectric substrate to the radiating element feed point.

3. An antenna as in claim 1 wherein said monomicrostrip antenna is fed from microstrip transmission lines disposed on the surface of said dielectric substrate.

4. An antenna as in claim 1 wherein said thin rectangular radiating element is in the form of a square, said square element being the limit as to how wide the element can be without exciting higher order modes of oscillation.

5. An antenna as in claim 1 wherein the length of said radiating element and the length of said ground plane is approximately ½ wavelength.

6. An antenna as in claim 1 wherein said antenna operates to provide an omnidirectional far field pattern in the XY plane and an omnidirectional far field pattern in the XZ plane such that the overall radiation of the antenna is near isotropic.

7. An antenna as in claim 1 wherein at least one extension of a portion of the width of said radiating element is provided at any of the ends thereof; said at least one width extension acting as a reactive load for the monomicrostrip antenna for obtaining lower frequency without increasing the length thereof.

8. An antenna as in claim 1 wherein both the radiating element and the non-radiating ground plane are notched from one end thereof along the centerline to the feed point and both the element and ground plane are fed from twin microstrip transmission lines.

9. An antenna as in claim 1 wherein the width of said ground plane extends a minimum of approximately ⅛ wavelength on each side beyond the width of said radiating element.

10. An asymmetrically fed electric monomicrostrip dipole antenna structure for providing isotropic radiation, comprising:

a. a dielectric substrate;

b. a thin rectangular radiating element disposed on one side of said dielectric substrate;

c. a thin non-radiating ground plane conductor disposed on the other side of said dielectric substrate directly opposite to said radiating element;

d. said ground plane being identical in length to the length of said radiating element; said ground plane and said radiating element being aligned lengthwise;

e. said ground plane extending in width on each side beyond the width of said radiating element to cause a mismatch such that the ground plane will not be excited;

f. said radiating element operable to be excited to radiate about both the element and the ground plane side of the antenna in a near isotropic manner; the fields on both sides of the antenna being in phase;

g. the length of said radiating element determining the resonant frequency of the antenna;

h. said radiating element having a feed point located long the centerline of the length thereof;

i. the antenna input impedance being variable to match most practical impedances as said feed point is moved along the element centerline without affecting the radiation pattern;

j. the antenna bandwidth being variable with the width of said radiating element and the spacing between the radiating element and said ground plane, said spacing between the radiating element and ground plane having the most effect.

11. An antenna as in claim 9 wherein said monomicrostrip antenna is fed from a coaxial-to-microstrip adapter from the ground plane side of the antenna with the center pin of the adapter extending through the ground plane and the dielectric substrate to the radiating element feed point.

12. An antenna as in claim 9 wherein said thin rectangular radiating element is in the form of a square, said square element being the limit as to how wide the element can be without exciting higher order modes of oscillation.

13. An antenna as in claim 9 wherein both the length of said radiating element and the length of said ground plane is approximately ½ wavelength.

14. An antenna as in claim 9 wherein said antenna operates to provide an omnidirectional far field pattern in the XY plane and an omnidirectional far field pattern in the XZ plane such that the overall radiation of the antenna is near isotropic.

15. An antenna as in claim 9 wherein at least one extension of a portion of the width of said radiating element is provided at any of the ends thereof; said at least one width extension acting as a reactive load for the monomicrostrip antenna for obtaining lower frequency without increasing the length thereof.

16. An antenna as in claim 10 wherein polarization is linear along the length thereof.

17. An antenna as in claim 10 wherein the minimum width of said antenna element is determined by the thickness of said dielectric substrate.

18. An end fed electric monomicrostrip dipole antenna structure for providing isotropic radiation comprising:

a. a dielectric substrate;

b. a thin rectangular radiating element disposed on one side of said dielectric substrate;

c. a thin non-radiating ground plane conductor disposed on the other side of said dielectric substrate directly opposite to said radiating element;

d. said ground plane being identical in length to the length of said radiating element; said ground plane and said radiating element being aligned lengthwise;

e. said ground plane extending in width on each side beyond the width of said radiating element to cause a mismatch such that the ground plane will not be excited;

f. said radiating element operable to be excited to radiate about both the element and the ground plane side of the antenna in a near isotropic manner; the field on both sides of the antenna being in phase;

g. the length of said radiating element determining the resonant frequency of the antenna;

h. said radiating element having a feed point located at an end of the length of the centerline thereof.

19. An antenna as in claim 18 wherein the length of said radiating element is approximately one-half wavelength and the width is approximately one wavelength to provide quadrupole action; said radiating element operating in a degenerate mode with two oscillation modes occurring at the same frequency, oscillation in a dipole mode occurring along the length of the antenna and in a quadrupole mode occurring along the width of the radiating element.

20. An antenna as in claim 18 wherein the input impedance to said antenna is matched to most practical impedances with matching twin microstrip transmission lines disposed on opposite sides of said dielectric substrate without affecting the antenna radiation pattern, one of said twin transmission lines connected to said element feed point and the other of said twin transmission lines connected to said ground plane.

21. An antenna as in claim 18 wherein said monomicrostrip antenna is fed from a coaxial-to-microstrip adapter from the ground plane side of the antenna with the center pin of the adapter extending through the ground plane and the dielectric substrate to the radiating element feed point.

22. An antenna as in claim 18 wherein said thin rectangular radiating element is in the form of a square, said square element being the limit as to how wide the element can be without exciting higher order modes of oscillation.

23. An antenna as in claim 18 wherein the length of said radiating element and the length of said ground plane is approximately ½ wavelength.

24. An antenna as in claim 18 wherein said antenna operates to provide an omnidirectional far field pattern in the XY plane and an omnidirectional far field pattern in the XZ plane such that the overall radiation of the antenna is near isotropic.

25. An antenna as in claim 18 wherein at least one extension of a portion of the width of said radiating element is provided at any of the ends thereof; said at least one width extension acting as a reactive load for the monomicrostrip antenna for obtaining lower frequency without increasing the length thereof.

26. An offset fed electric monomicrostrip dipole antenna structure for providing isotropic radiation comprising:

a. a dielectric substrate;

b. a thin rectangular radiating element disposed on one side of said dielectric substrate;

c. a thin non-radiating ground plane conductor disposed on the other side of said dielectric substrate directly opposite to said radiating element;

d. said ground plane being identical in length to the length of said radiating element; said ground plane and said radiating element being aligned lengthwise;

e. said ground plane extending in width on each side beyond the width of said radiating element to cause a mismatch such that the ground plane will not be excited;

f. said radiating element operable to be excited to radiate about both the element and the ground plane side of the antenna in a near isotropic manner; the fields on both sides of the antenna being in phase;

g. the length of said radiating element determining the resonant frequency of the antenna;

h. said radiating element having a feed point located along an edge of the length thereof;

i. the input impedance of said antenna being variable to match most practical impedances as said feed point is moved along the edge of the length of said radiating element without affecting the antenna radiation pattern;

j. the antenna bandwidth being variable with the width of said radiating element and the spacing between the radiating element and said ground plane, said spacing between the radiating element and ground plane having the most effect.

27. An antenna as in claim 26 wherein said radiating element oscillates in a resonant mode along the length thereof and in a non-resonant mode along the width thereof when the element width is greater than one-half the element length.

28. An antenna as in claim 26 wherein the minimum width of said antenna element is determined by the thickness of said dielectric substrate.

29. An antenna as in claim 26 wherein said monomicrostrip antenna is fed from a coaxial-to-microstrip adapter from the ground plane side of the antenna with the center pin of the adapter extending through the ground plane and the dielectric substrate to the radiating element feed point.

30. An antenna as in claim 26 wherein said monomicrostrip antenna is fed from microstrip transmission lines disposed on the surface of said dielectric substrate.

31. An antenna as in claim 26 wherein said thin rectangular radiating element is in the form of a square, said square element being the limit as to how wide the element can be without exciting higher order modes of oscillation.

32. An antenna as in claim 26 wherein the length of said radiating element and the length of said ground plane is approximately ½ wavelength.

33. An antenna as in claim 26 wherein said antenna operates to provide an omnidirectional far field pattern in the XY plane and an omnidirectional far field pattern in the XZ plane such that the overall radiation of the antenna is near isotropic.

34. An antenna as in claim 26 wherein at least one extension of a portion of the width of said radiating element is provided at any of the ends thereof; said at least one width extension acting as a reactive load for the monomicrostrip antenna for obtaining lower frequency without increasing the length thereof.

35. A diagonally fed electric monomicrostrip dipole antenna structure for providing isotropic radiation, comprising:

a. a dielectric substrate;

b. a thin rectangular radiating element disposed on one side of said dielectric substrate;

c. a thin non-radiating ground plane conductor disposed on the other side of said dielectric substrate directly opposite to said radiating element;

d. said ground plane being identical in length to the length of said radiating element; said ground plane and said radiating element being aligned lengthwise;

e. said ground plane extending in width on each side beyond the width of said radiating element to cause a mismatch such that the ground plane will not be excited;

f. said radiating element operable to be excited to radiate about both the element and the ground plane side of the antenna in a near isotropic manner; the fields on both sides of the antenna being in phase;

g. the length of said radiating element determining the resonant frequency of the antenna;

h. said radiating element having a single feed point located along a diagonal line of the element between the outer edge and center point thereof;

i. the input impedance of said antenna being variable to match most practical impedances as said feed point is moved along said diagonal line;

j. the antenna bandwidth being variable with the width of said radiating element and the spacing between the radiating element and said ground plane, said spacing between the radiating element and ground plane having the most effect;

k. said radiating element being operable to oscillate in two modes of current oscillation, said two modes being orthogonal to each other and with mutual coupling being minimal, the properties of each mode of oscillation being determined independently of one another; the parallel combination of the input impedance of each mode providing a combined antenna input impedance;

l. polarization of the antenna being linear when the radiating element length and width are equal, the antenna polarization being circular when the phase difference between the two modes of oscillation are in quadrature due to differences between the length and width of the radiating element.

36. An antenna as in claim 35 wherein said radiating element is in the form of a square and the polarization is linear along the diagonal on which the feed point lies.

37. An antenna as in claim 35 wherein said monomicrostrip antenna is fed from a coaxial-to-microstrip adapter from the ground plane side of the antenna with the center pin of the adapter extending through the ground plane and the dielectric substrate to the radiating element feed point.

38. An antenna as in claim 35 wherein the length of said radiating element and the length of said ground plane is approximately ½ wavelength.

39. An antenna as in claim 35 wherein said antenna operates to provide an omnidirectional far field pattern in the XY plane and an omnidirectional far field pattern in the XZ plane such that an overall radiation of the antenna is near isotropic.

40. An antenna as in claim 35 wherein at least one extension of a portion of the width of said radiating element is provided at any of the ends thereof; said at least one width extension acting as a reactive load for the monomicrostrip antenna for obtaining lower frequency without increasing the length thereof.

41. An antenna as in claim 35 wherein the radiation pattern of said antenna is operable to be circularly polarized by advancing one mode of current oscillation and retarding the other mode of current oscillation until there is a 90 degree phase difference between the two modes and by coupling the same amount of current into each mode.

42. An antenna as in claim 35 wherein a slight change in the element length from being equal dimension to the element width up to approximately 0.5% difference will result in changes in some of the antenna characteristics and cause the polarization of the radiating element to change from linear along the diagonal to near circular polarization.

43. An antenna as in claim 35 wherein each of the two modes of oscillation in the radiating element have the same properties and one-half the available power is coupled to one mode of oscillation and one-half the available power is coupled to the other mode of oscillation.

44. A notched/diagonally fed electric monomicrostrip antenna structure, comprising:

a. a dielectric substrate;

b. a thin rectangular radiating element disposed on one side of said dielectric substrate;

c. a thin non-radiating ground plane conductor disposed on the other side of said dielectric substrate directly opposite to said radiating element;

d. said ground plane being identical in length to the length of said radiating element; said ground plane and said radiating element being aligned lengthwise;

e. said ground plane extending in width on each side beyond the width of said radiating element to cause a mismatch such that the ground plane will not be excited;

f. said radiating element operable to be excited to radiate about both the element and the ground plane side of the antenna in a near isotropic manner; the fields on both sides of the antenna being in phase;

g. the length of said radiating element determining the resonant frequency of the antenna;

h. said radiating element having a single feed point located along a diagonal line of the element between the outer edge and center point thereof;

i. said radiating element having a notch extending into said element from the outer edge thereof along said diagonal line to said feed point;

j. the input impedance of said antenna being variable to match most practical impedances as said feed point is moved along said diagonal line;

k. the resonant frequency of the antenna being determined primarily by the length of said radiating element; the width of the notch having a slight effect on the resonant frequency, as the notch width is increased, the resonant frequency being slightly increased, and vice versa;

l. said radiating element being operable to oscillate in two modes of current oscillation, said two modes being orthogonal to one another;

m. said radiating element being operable to oscillate in two modes of current oscillation, said two modes being orthogonal to each other with mutual coupling being minimal, the properties of each mode of oscillation being determined independently of one another; the parallel combination of the input impedance of each mode providing a combined antenna imput impedance.

45. An antenna as in claim 44 wherein said monomicrostrip antenna is fed from a coaxial-to-microstrip adapter from the ground plane side of the antenna with the center pin of the adapter extending through the ground plane and the dielectric substrate to the radiating element feed point.

46. An antenna as in claim 44 wherein said monomicrostrip antenna is fed from microstrip transmission lines disposed on the surface of said dielectric substrate.

47. An antenna as in claim 44 wherein the length of said radiating element and the length of said ground plane is approximately ½ wavelength.

48. An antenna as in claim 44 wherein said antenna operates to provide an omnidirectional far field pattern in the XY plane and an omnidirectional far field pattern in the XZ plane such that the overall radiation of the antenna is near isotropic.

49. An antenna as in claim 44 wherein at least one extension of a portion of the width of said radiating element is provided at any of the ends thereof; said at least one width extension acting as a reactive load for the monomicrostrip antenna for obtaining lower frequency without increasing the length thereof.

50. An antenna as in claim 44 wherein a slight change in the element length from being equal dimension to the element width up to approximately 0.5% difference will result in changes in some of the antenna characteristics and cause the polarization of the radiating element to change from linear along the diagonal to near circular polarization.

51. An antenna as in claim 44 wherein the antenna radiation pattern can be varied from diagonal fields to circulating fields, depending upon the input impedance of each of said two modes of current oscillation.

52. An antenna as in claim 44 wherein the radiation pattern of said antenna is operable to be circularly polarized by advancing one mode of current oscillation and retarding the other mode of current oscillation until there is a 90 degree phase difference between the two modes and by coupling the same amount of current into each mode.

53. An electric monomicrostrip dipole antenna structure, comprising:

a. a dielectric substrate;

b. a thin radiating element disposed on one side of said dielectric substrate;

c. a thin non-radiating ground plane conductor disposed on the other side of said dielectric substrate directly opposite to said radiating element;

d. said ground plane being identical in length to the length of said radiating element; said ground plane and said radiating element being aligned lengthwise;

e. said ground plane extending in width on each side beyond the width of said radiating element to cause a mismatch such that the ground plane will not be excited;

f. said radiating element operable to be excited to radiate about both the element and the ground plane side of the antenna in a near isotropic manner; the fields on both sides of the antenna being in phase;

g. the length of said radiating element determining the resonant frequency of the antenna;

h. said radiating element being any of asymmetrically fed, notch fed, offset fed, diagonally fed, notched/diagonally fed, and offset/notch fed at a feed point located on the element;

i. the input impedance of said antenna being variable to match most practical impedances as said feed point is moved on the radiating element;

j. the antenna bandwidth being variable with the width of said radiating element and the spacing between the radiating element and said ground plane, said spacing between the radiating element and ground plane having the most effect.

54. An antenna as in claim 53 wherein said monomicrostrip antenna is fed from a coaxial-to-microstrip adapter from the ground plane side of the antenna with the center pin of the adapter extending through the ground plane and the dielectric substrate to the radiating element feed point.

55. An antenna as in claim 53 wherein said monomicrostrip antenna is fed from microstrip transmission lines disposed on the surface of said dielectric substrate.

56. An antenna as in claim 53 wherein the length of said radiating element and the length of said ground plane is approximately ½ wavelength.

57. An antenna as in claim 53 wherein said antenna operates to provide an omnidirectional far field pattern in the XY plane and an omnidirectional far field pattern in the XZ plane such that the overall radiation of the antenna is near isotropic.

58. An antenna as in claim 53 wherein at least one extension of a portion of the width of said radiating element is provided at any of the ends thereof; said at least one width extension acting as a reactive load for the monomicrostrip antenna for obtaining lower frequency without increasing the length thereof.

59. An antenna as in claim 53 wherein the width of said ground plane extends a minimum of approximately ⅛ wavelength on each side beyond the width of said radiating element.

60. An antenna as in claim 53 wherein said radiating element has a center conducting portion thereof removed and a secondary element, smaller than the removed portion, disposed on the surface of said substrate within the area of said removed portion and spaced from said radiating element; said secondary element also being operable to be excited and radiate when being any of: coupled fed from the larger said radiating element, secondarily fed from the larger said radiating element, fed from a T-feed line along wiith the larger said radiating element, and separately fed with a separate feed line to a feed point thereon.

* * * * *